US008010033B2

(12) United States Patent
Blair et al.

(10) Patent No.: US 8,010,033 B2
(45) Date of Patent: Aug. 30, 2011

(54) FUSER MEMBER COMPRISING DEFLOCCULATED MATERIAL

(75) Inventors: Christopher David Blair, Webster, NY (US); Ugur Sener, Webster, NY (US); Robert N. Finsterwalder, Webster, NY (US); Joy L. Longhenry, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 11/782,024

(22) Filed: Jul. 24, 2007

(65) Prior Publication Data

US 2008/0019743 A1 Jan. 24, 2008

Related U.S. Application Data

(63) Continuation of application No. 11/135,586, filed on May 23, 2005.

(51) Int. Cl.
*G03G 15/20* (2006.01)

(52) U.S. Cl. ..... 399/333

(58) Field of Classification Search ..... 399/333, 399/328; 219/216
See application file for complete search history.

(56) References Cited

U.S. PATENT DOCUMENTS 4,898,752 A * 2/1990 Cavagna et al. ..... 427/265
5,281,506 A 1/1994 Badesha et al.
5,332,641 A 7/1994 Finn et al.
5,370,931 A 12/1994 Fratangelo et al.
5,700,568 A * 12/1997 Badesha et al. ..... 428/334
5,750,204 A 5/1998 Badesha et al.
5,753,307 A 5/1998 Badesha et al.
5,945,223 A 8/1999 Kuntz et al.
6,052,550 A * 4/2000 Thornton et al. ..... 399/237
6,408,753 B1 6/2002 Finn et al.
6,434,355 B1 8/2002 Badesha et al.
6,478,158 B2 11/2002 Gaffney et al.
6,521,330 B2 2/2003 Finn et al.
6,625,416 B1 * 9/2003 Badesha et al. ..... 399/308
6,716,502 B1 * 4/2004 Badesha et al. ..... 428/35.8
6,829,466 B2 12/2004 Finn et al.
6,838,140 B1 1/2005 Heeks et al.
7,485,344 B2 2/2009 Kaplan et al.
2003/0039913 A1 * 2/2003 Kadokura et al. ..... 430/124
2006/0269736 A1 * 11/2006 Finn ..... 428/323

FOREIGN PATENT DOCUMENTS

JP 06344470 A * 12/1994
JP 2001235954 A * 8/2001

OTHER PUBLICATIONS

Translation of JP2001-235954A, Aug. 31, 2001.*

* cited by examiner

*Primary Examiner* — Quana M Grainger
(74) *Attorney, Agent, or Firm* — MH2 Technology Law Group LLP

(57) ABSTRACT

A fuser component useful in electrostatographic machines is provided, having a substrate, and thereover a coating composition comprising a haloelastomer, such as, for example, a fluoroelastomer, and a deflocculating agent. A fuser component comprising a deflocculating agent exhibits improved properties including, but not limited to, increased gloss and a smoother coating surface with a relatively high adhesive strength. The use of a deflocculating agent also reduces or eliminates the barium sulfate defect.

3 Claims, 2 Drawing Sheets

FUSER MEMBER COMPRISING DEFLOCCULATED MATERIAL

CROSS-REFERENCE TO RELATED APPLICATIONS

This application is a continuation of U.S. patent application Ser. No. 11/135,586, filed May 23, 2005, titled "FUSER MEMBER COMPRISING DEFLOCCULATED MATERIAL." That application is hereby fully incorporated by reference.

This application is also related to U.S. patent application Ser. No. 11/135,812, the disclosure of which is hereby incorporated by reference in its entirety.

BACKGROUND

The present disclosure relates, in various embodiments, to an imaging member or apparatus and fuser components thereof. In particular, the present disclosure relates to a fuser member that includes an outer coating layer comprising a haloelastomer and a deflocculating agent. A fuser member in accordance with the present disclosure is suitable for use in electrostatographic and xerographic printing processes and is described with particular reference thereto. It is to be appreciated by persons skilled in the art that fusers in accordance with the present disclosure are amenable to any image forming apparatus including, but not limited to, color image forming devices.

In a typical electrostatographic reproducing apparatus, a light image of an original to be copied is recorded in the form of an electrostatic latent image upon a photosensitive member and the latent image is subsequently rendered visible by the application of electroscopic thermoplastic resin particles which are commonly referred to as toner. The visible toner image is then in a loose powdered form and can be easily disturbed or destroyed. The toner image is usually fixed or fused upon a support, which may be the photosensitive member itself, or other support sheet such as plain paper.

The use of thermal energy for fixing toner images onto a support member is well known and methods include providing the application of heat and pressure substantially concurrently by various means such as, for example, a roll pair maintained in pressure contact, a belt member in pressure contact with a roll, a belt member in pressure contact with a heater, and the like. Heat may be applied by heating one or both of the rolls, plate members, or belt members. With a fixing apparatus using a thin film in pressure contact with a heater, the electric power consumption is small, and the warming-up period is significantly reduced or eliminated.

It is important in the fusing process that minimal or no offset of the toner particles from the support to the fuser member take place during normal operations. Toner particles offset onto the fuser member may subsequently transfer to other parts of the machine or onto the support in subsequent copying cycles, thus increasing the background or interfering with the material being copied there. The referred to "hot offset" occurs when the temperature of the toner is increased to a point where the toner particles liquify and a splitting of the molten toner takes place during the fusing operation with a portion remaining on the fuser member. The hot offset temperature or degradation of the hot offset temperature is a measure of the release property of the fuser, and accordingly it is desired to provide a fusing surface, which has a low surface energy to provide the necessary release. To ensure and maintain good release properties of the fuser, it has become customary to apply release agents to the fuser roll during the fusing operation. Typically, these materials are applied as thin films of, for example, silicone oils to prevent toner offset.

Another important method for reducing offset is to impart antistatic and/or field assisted toner transfer properties to the fuser. To control the electrical conductivity of the release layer, however, the conformability and low surface energy properties of the release layer are often affected.

Known fuser coatings include high temperature polymers such as polytetrafluoroethylene, perfluoroalkoxy, fluorinated ethylene propylene, silicone rubber, fluorosilicone rubber, fluoroelastomers, and the like. These coatings have been found to have adequate release properties and control toner offset sufficiently. Problems, however, have resulted with known fuser member layers. For example, the fuser member may prematurely harden, which results in a life short fall. Some known fuser members have also been shown to exhibit a susceptibility to contamination, scratching and other damage. Further, silicone rubber layers tend to swell upon application of release agents. Moreover, fuser members have been shown to provide toner offset or inferior release capability, which allows for inappropriate copies and/or prints, and toner contamination to other parts of the machine.

One of the problems associated with fuser rolls coated with, for example, a fluoroelastomer, is that such coatings have a failure mode where the prints develop noticeable gloss variation as the coating wears. While even the worn areas of a fuser rolls often yield absolute gloss that is within the specification or tolerance limits of an imaging apparatus, a variation of as little as 2 gloss units is detectible by the human eye and may be deemed a failure or unacceptable result.

Another problem associated with fuser rolls coated with a fluoroelastomer is a defect known as barium sulfate defect. Barium sulfate is often added to and present on the surface of a fluoroelastomer polymer material to keep individual polymer pellets or particles from agglomerating. Barium sulfate, however, is otherwise not a necessary component to the functioning of the coating material. Barium sulfate defect results from agglomeration of insoluble barium sulfate present in the coating. Moreover, fuser roll outer-layers produced by the flow coat process exhibit additional defects that occur particularly when the coatings are very thin, for example less than 50 micrometers in thickness. These defects include "snowflake agglomerates," which are due to agglomeration of particles such as barium sulfate added to certain fluoroelastomers to prevent the fluoroelastomer pellets from sticking together, and "fisheyes," which are typically 1 to 5 millimeter regions either devoid of a fluoroelastomer layer, or with a very thin fluoroelastomer layer. Such defects in the fuser roll outer-layer can cause undesirable image defects on the printed copy, such as toner spots, toner picking (i.e., removal of toner leaving white spots), non-uniform gloss, hot offset, and poor image permanence. There exists a need for a flow coating solution that forms a fuser roll outer-layer surface that is smooth and free of such defects.

Therefore, a need remains for fuser components for use in electrostatographic machines that have superior mechanical properties. Further, a need remains for fuser coatings having reduced susceptibility to contamination, scratching, and other damage. There is also a need for a coating layer that exhibits a relatively low roughness and is suitable for a fuser member. In addition, a need remains for a fuser component having a longer life. Even further, a need remains for a fuser component that maintains a high gloss.

BRIEF DESCRIPTION

The present disclosure relates, in embodiments thereof, to a fuser member for fixing a developed image to a copy substrate, comprising a substrate; and thereover an outer layer comprising a haloelastomer and a deflocculating agent.

Moreover, the present disclosure is directed to, in embodiments thereof, a fuser member for fixing a developed image to a copy substrate comprising a substrate; and thereover an outer layer comprising a fluoroelastomer and a deflocculating agent.

The present disclosure also relates, in embodiments thereof, to an image forming apparatus for forming images on a recording medium comprising a charge-retentive surface to receive an electrostatic latent image thereon; a development component to apply toner to the charge-retentive surface to develop an electrostatic latent image to form a developed image on the charge-retentive surface; a transfer film component to transfer the developed image from the charge-retentive surface to a copy substrate; and a fusing component for fusing toner images to a surface of the copy substrate, the fusing component comprising a substrate; and thereover an outer layer comprising a fluoroelastomer and a deflocculating agent.

These and other non-limiting characteristics of the development are more particularly disclosed below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
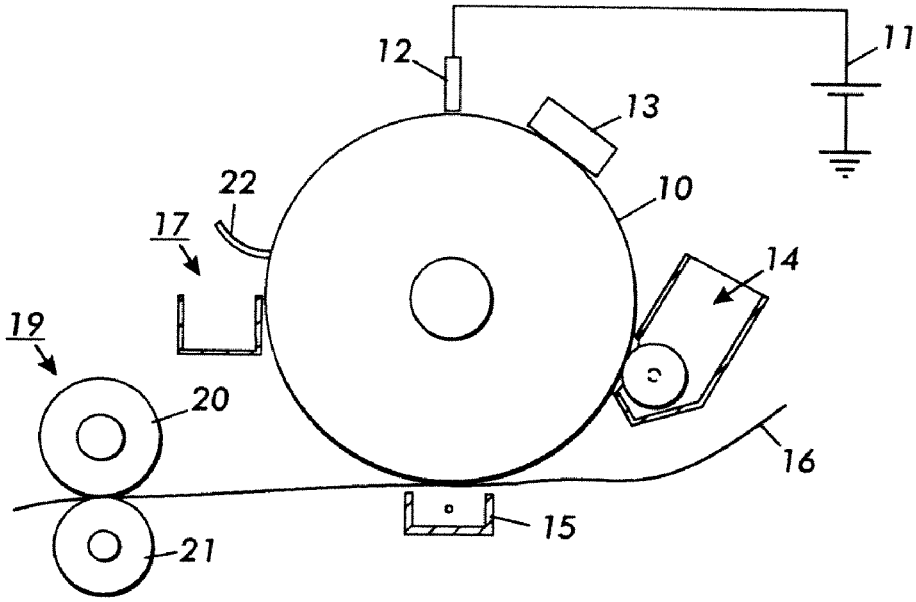
FIG. 1 is an illustration of a general electrostatographic apparatus.

The present disclosure concerns an imaging member or apparatus and fuser components thereof for use in electrostatographic, including digital, contact electrostatic printing, and like apparatuses. The fuser components include a fuser member or roll for fixing a developed image on a copy substrate. The fuser member comprises a substrate and, thereover, an outer layer comprising a haloelastomer and a deflocculating agent.

A more complete understanding of the components, processes and apparatuses disclosed herein can be obtained by reference to the accompanying drawings. These figures are merely schematic representations based on convenience and the ease of demonstrating the present development, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

Referring to FIG. 1, in a typical electrostatographic reproducing apparatus, a light image of an original to be copied is recorded in the form of an electrostatic latent image upon a photosensitive member and the latent image is subsequently rendered visible by the application of electroscopic thermoplastic resin particles, which are commonly referred to as toner. Specifically, photoreceptor 10 is charged on its surface by means of a charger 12 to which a voltage has been supplied from power supply 11. The photoreceptor is then imagewise exposed to light from an optical system or an image input apparatus 13, such as a laser and light emitting diode, to form an electrostatic latent image thereon. Generally, the electrostatic latent image is developed by bringing a developer mixture from developer station 14 into contact therewith. Development can be effected by use of a magnetic brush, powder cloud, or other known development process.

After the toner particles have been deposited on the photoconductive surface, in image configuration, they are transferred to a copy sheet 16 by transfer means 15, which can be pressure transfer or electrostatic transfer. Alternatively, the developed image can be transferred to an intermediate transfer member and subsequently transferred to a copy sheet.

After the transfer of the developed image is completed, copy sheet 16 advances to fusing station 19, depicted in FIG. 1 as fusing and pressure rolls, wherein the developed image is fused to copy sheet 16 by passing copy sheet 16 between the fusing member 20 and pressure member 21, thereby forming a permanent image. Photoreceptor 10, subsequent to transfer, advances to cleaning station 17, wherein any toner left on photoreceptor 105 is cleaned therefrom by use of a blade 22 (as shown in FIG. 1), brush, or other cleaning apparatus. Although the fusing station 19 depicts the fusing and pressure members as rollers, the fuser and/or pressure member(s) may also be in the form of belts, sheets, films or other like fusing members.

Figure 2:
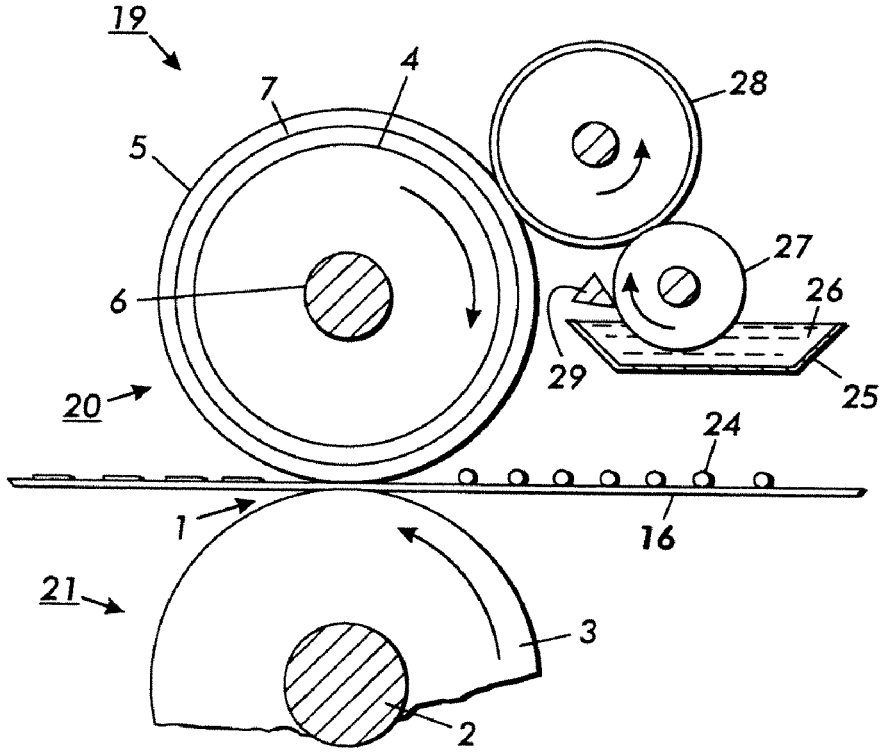
FIG. 2 is a sectional view of a fusing belt in accordance with an embodiment of the present disclosure.

Referring to FIG. 2, an embodiment of a fusing station 19 is depicted with an embodiment of a fuser roll 20 comprising polymer surface 5 upon a suitable base member 4, a hollow cylinder or core fabricated from any suitable metal, such as aluminum, anodized aluminum, steel, nickel, copper, and the like, having a suitable heating element 6 disposed in the hollow portion thereof which is coextensive with the cylinder. The fuser member 20 can include an adhesive, cushion, or other suitable layer 7 positioned between core 4 and outer layer 5. Backup or pressure roll 21 cooperates with fuser roll 20 to form a nip or contact arc 1 through which a copy paper or other substrate 16 passes such that toner images 24 thereon contact elastomer surface 5 of fuser roll 20. As shown in FIG. 2, an embodiment of a backup roll or pressure roll 21 is depicted as having a rigid steel core 2 with a polymer or elastomer surface or layer 3 thereon. Sump 25 contains polymeric release agent 26 that may be a solid or liquid at room temperature, but it is a fluid at operating temperatures. The pressure member 21 may include a heating element (not shown).

In the embodiment shown in FIG. 2 for applying the polymeric release agent 26 to polymer or elastomer surface 5, two release agent delivery rolls 27 and 28 rotatably mounted in the direction indicated are provided to transport release agent 26 to polymer or elastomer surface 5. Delivery roll 27 is partly immersed in the sump 25 and transports on its surface release agent from the sump to the delivery roll 28. By using a metering blade 29, a layer of polymeric release fluid can be applied initially to delivery roll 27 and subsequently to polymer or elastomer 5 in controlled thickness ranging from submicrometer thickness to thicknesses of several micrometers of release fluid. Thus, in embodiments, by metering device 29, from about 0.1 to about 2 micrometers or greater thicknesses of release fluid can be applied to the surface of polymer or elastomer 5.

Figure 3:
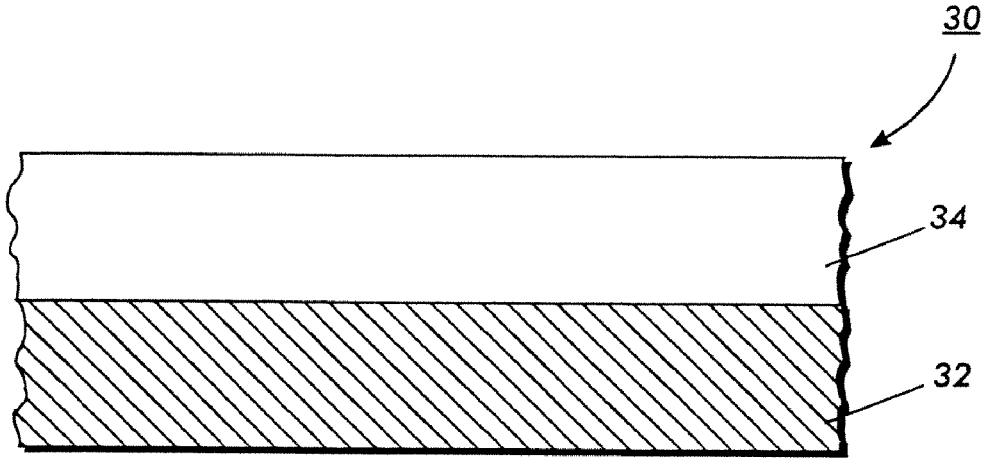
FIG. 3 is a schematic sectional view of a fuser component having a two layer configuration, wherein the outer layer comprises a coating in accordance with the present disclosure.

With reference to FIG. 3, an embodiment of a fusing component is shown. FIG. 3 depicts a fusing component 30 having a two layer configuration and comprising a substrate 32 and an outer layer 34 positioned over the substrate. Outer layer 34 comprises a haloelastomer such as, for example, a fluoroelastomer, and a deflocculating disbursed or contained therein.

Figure 4:
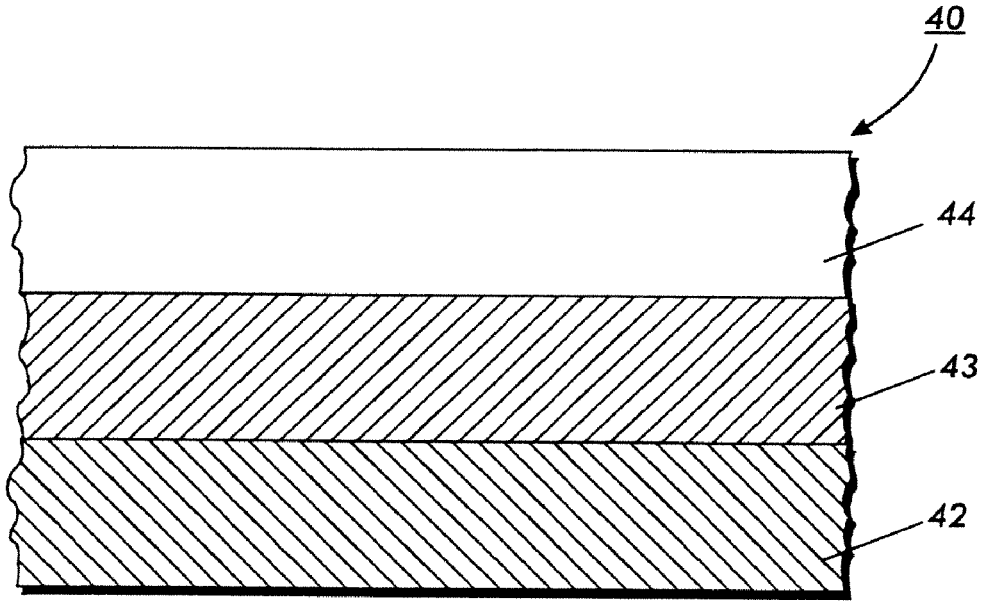
FIG. 4 is a schematic cross sectional view of a fuser component having a three layer configuration, wherein the outer layer comprises a coating in accordance with the present disclosure.

With reference to FIG. 4, a fuser component 40 having a three layer configuration is shown. Fuser component 40 includes substrate 42 outer layer 44, and intermediate layer 43 disposed between substrate layer 42 and outer layer 44. Outer layer 44 comprises a coating composition in accordance with the present disclosure, which comprises a haloelastomer, such as a fluoroelastomer, and a deflocculating disbursed or contained therein.

While the fuser components depicted in FIGS. 3 and 4 are shown as fuser belts, the fuser component in accordance with the present disclosure can be of any suitable configuration. For example, a fuser component may be in the form of sheet, a film, a web, a foil, a strip, a coil, a cylinder, a drum, a roller, an endless strip, a circular disc, a belt including an endless belt, an endless seamed flexible belt, an endless seamless flexible belt, an endless belt having a puzzle cut seam, and the like.

It will be further appreciated by those skilled in the art that a fuser component in accordance with the present disclosure is not limited to two layer and/or three layer configurations. A fuser component in accordance with the present disclosure may include any number of intermediate layers and/or adhesive layers, as desired, disposed between a substrate and an outer layer.

Examples of suitable substrate materials include in the case of roller or film-type substrates, metals such as aluminum, stainless steel, steel, nickel and the like. In the case of film-type substrates, suitable substrates include high temperature plastics that are suitable for allowing a high operating temperature (i.e., greater than about 80° C., preferably greater than 200° C.), and capable of exhibiting high mechanical strength. In embodiments, the plastic has a flexural strength of from about 2,000,000 to about 3,000,000 psi, and a flexural modulus of from about 25,000 to about 55,000 psi. Plastics possessing the above characteristics and which are suitable for use as the substrate for the fuser members include epoxy; polyphenylene sulfide such as that sold under the tradenames FORTRON® available from Hoechst Celanese, RYTON R-4® available from Phillips Petroleum, and SUPEC® available from General Electric; polyimides such as polyamide-imide sold under the tradename TORLON® 7130 available from Amoco; polyketones such as those sold under the tradename KADEL® E1230 available from Amoco, polyether ether ketone sold under the tradename PEEK 450GL30 from Victrex, polyaryletherketone, and the like; polyamides such as polyphthalamide sold under the tradename AMODEL® available from Amoco; polyethers such as polyethersulfone, polyetherimide, polyaryletherketone, and the like; polyparabanic acid, and the like; liquid crystalline resin (XYDAR®) available from Amoco; ULTEM® available from General Electric; ULTRAPEK® available from BASF; and the like, and mixtures thereof. Other suitable substrate materials include fluoroelastomers such as those sold under the tradename VITON® from DuPont; silicone rubbers, and other elastomeric materials. The substrate may also comprise a mixture of any of the above materials. In embodiments, the substrate comprises aluminum.

The substrate as a film, sheet, belt, or the like, may have a thickness of from about 25 to about 250 micrometers, or, in some embodiments, from about 60 to about 100 micrometers.

The outer layer comprises a coating composition comprising a haloelastomer, such as, for example, a fluoroelastomer, and a deflocculating agent.

In embodiments, the outer layer comprises an elastomer, such as a haloelastomer. Examples of elastomers comprising halogen atoms include chloroelastomers, fluoroelastomers and the like. Examples of suitable fluoroelastomers include, but are not limited to, ethylenically unsaturated fluoroelastomers, and fluoroelastomers comprising copolymers and terpolymers of vinylidenefluoride, hexafluoropropylene and tetrafluoroethylene, which are known commercially under various designations as VITON A®, VITON B®, VITON E®, VITON F®, VITON E60C®, VITON E45®, VITON E430®, VITON B 910®, VITON GH®, VITON B50®, VITON E45®, and VITON GF®. The VITON® designation is a Trademark of E.I. DuPont de Nemours, Inc. Three known fluoroelastomers are (1) a class of copolymers of vinylidenefluoride, hexafluoropropylene and tetrafluoroethylene, known commercially as VITON A®, (2) a class of terpolymers of vinylidenefluoride, hexafluoropropylene and tetrafluoroethylene known commercially as VITON B®, and (3) a class of tetrapolymers of vinylidenefluoride, hexafluoropropylene, tetrafluoroethylene and a cure site monomer, these polymers including, for example, VITON GF®, VITON A®, and VITON B®.

In another embodiment, the fluoroelastomer is a tetrapolymer having a relatively low quantity of vinylidenefluoride. An example is VITON GF®, available from E.I. DuPont de Nemours, Inc. The VITON GF® has 35 weight percent of vinylidenefluoride, 34 weight percent of hexafluoropropylene and 29 weight percent of tetrafluoroethylene with 2 weight percent cure site monomer. The cure site monomer can be those available from DuPont such as 4-bromoperfluorobutene-1, 1,1-dihydro-4-bromoperfluorobutene-1,3-bromoperfluoropropene-1,1,1-dihydro-3-bromoperfluoropropene-1, or any other suitable, known, commercially available cure site monomer.

Other suitable fluoroelastomers include, but are not limited to, AFLAS®, FLUOREL® I, FLUOREL® II, TECHNOFLON® and the like commercially available elastomers.

The deflocculating agent includes any material known to act as a deflocculant. The deflocculating agent is capable of at least one of 1) decreasing the viscosity of the coating composition and/or 2) preventing flocculation of particles in the coating composition. In embodiments, the deflocculating agent reduces flocculation or agglomeration of a substantial portion of any insoluble barium sulfate particles present in the coating composition and reduces the barium sulfate defect. In other embodiments, the deflocculating agent prevents flocculation or agglomeration of any insoluble barium sulfate particles present in the coating composition and eliminates the barium sulfate defect.

An example of a suitable deflocculating agent includes Disperbyk polymer compositions available from BYK Chemie. A non-limiting example of a suitable Disperbyk polymer is Disperbyk-167™.

Other suitable deflocculating agents exist. Most are used in water based systems, however some are designed for solvent based systems (such as MibK). Polymethacrylic Acid (PMA) is a very common water based deflocculant used in the ceramics industry. Its molecular weight is chosen depending on the size of particles in suspension. Typically, a weight between 1,000 and 50,000 is chosen. Often a Na+ ion is attached to the PMA to provide for further deflocculation by electrostatic repulsion. This is commonly known as electrosteric stabilization because it uses both electrostatics and the steric hinderance provided by the polymer chain. Other common deflocculants used in water include, but are not limited to: Sodium Carbonate, Sodium Silicate, Sodium Borate, Tetrasodium pyrophosphate, and other sodium based materials.

Other Deflocculating agents (which may or may not be used in water) include, but are not limited to: Polyisobutylene, Polyvinyl Butyral, Polyethylene Glycol, Glycerol Tristerate, Corn oil, linseed oil, stearic acid, lanolin fatty acids, certain fish oils, dibutyl amine and many others.

The deflocculating agent may be present in an amount of from about 0.1 to about 10 percent by weight of the halo/fluoroelastomer. The amount of deflocculating agent is based on the specific surface area of the particles to be deflocculated. This specific surface area is determined by the particles shape and size and can be determined via an analytic technique known as BET Nitrogen Absorption. In embodiments, the deflocculating agent is present in an amount of from about 1 to about 6 percent by weight of the halo/fluoroelastomer. In other embodiments, the deflocculating agent is present in an amount of from about 2 to about 4 percent by weight of the halo/fluoroelastomer. In one embodiment, the deflocculating agent is a Disperbyk polymer present in an amount of from about 1 to about 4 percent by weight of the halo/fluoroelastomer. The polymer is a copolymer of polycaprolactone and aromatic polyisocyanurate based on tolyl diisocyanate (TDI). It is in solvents of methoxypropylacetate and butyl acetate. The product literature claims that BYK-167 acts via steric stabilization, only and does not posses an ionic component.

The outer layer composition may optionally comprise a surfactant. In one embodiment, the outer layer comprises a surfactant. A surfactant is an organic compound containing a hydrophilic group on one end and a hydrophobic group on the other end. Examples of materials suitable for use as a surfactant in an outer layer include, but are not limited to, Fluorosurfactants such as FC430, by 3M Corporation. FC430 is an amphiphilic material containing an oleophobic and hydrophobic perfluorinated tail ($C_8$) and a polar hydrophilic head. Another exemplary surfactant is 3M Novec® FC-4430, a non-ionic polymeric fluorosurfactant with four perfluorinated carbon atoms. In another embodiment, the outer layer is substantially free of a surfactant. The benefits achieved by employing a deflocculating agent in the outer layer are not adversely affected by the presence or absence of a surfactant. The use of a deflocculating agent enables the outer layer to be formed without the need for any additional surfactant.

The coating compositions comprising the haloelastomer and deflocculating agent may be prepared by any suitable method including, for example, mixing of the haloelastomer and the deflocculating agent.

In embodiments, the thickness of the outer layer is from about 5 to about 250 microns. In other embodiments, the thickness of the outer layer is from about 15 to about 150 microns. In still other embodiments, the thickness of the other layer is from about 20 to about 25 microns.

In an optional embodiment, an intermediate layer may be positioned between the imaging substrate and the outer layer. Materials suitable for use in the intermediate layer include silicone materials, elastomers such as fluoroelastomers, fluorosilicones, ethylene propylene diene rubbers, silicone rubbers such as fluorosilicones, phenyl silicones, silicone blends, and the like. Additional polymers useful as the outer release layer include fluoropolymers such as polytetrafluoroethylene (PTFE), fluorinated ethylenepropylene copolymer (FEP), polyfluoroalkoxy polytetrafluoroethylene (PFA Teflon), ethylene chlorotrifluoro ethylene (ECTFE), ethylene tetrafluoroethylene (ETFE), polytetrafluoroethylene perfluoromethylvinylether copolymer (MFA), and the like. These polymers, together with adhesives, can also be included as intermediate layers and the like, and mixtures thereof. In embodiments, the intermediate layer is conformable and is of a thickness of from about 2 to about 60 mils, or from about 4 to about 25 mils.

Examples of suitable adhesives include silanes such as amino silanes (such as, for example. A1100 from OSI Specialties, Friendly West Va.), titanates, zirconates, aluminates, and the like, and mixtures thereof. In an embodiment, an adhesive in from about 0.25 to about 10 percent solution can be wiped on the substrate. The adhesive layer can be coated on the substrate or on the intermediate layer, to a thickness of from about 2 to about 2,000 nanometers, or from about 2 to about 500 nanometers. The adhesive can be coated by any suitable, known technique, including spray coating or wiping.

The substrate, optional intermediate layer(s), and outer layer may also include fillers dispersed therein. The fillers in the substrate, optional intermediate layer(s), and outer layer are optional, not critical, and not limited in any manner. Examples of suitable fillers for the substrate, optional intermediate layer(s), and/or outer layer include those described in U.S. Pat. Nos. 6,829,466 and 6,838,140, the entire disclosures of which are incorporated herein by reference.

The following examples are for purposes of further illustrating fuser components in accordance with the present disclosure. The examples are merely illustrative and are not intended to limit fuser components in accordance with the disclosure to the materials, conditions, or process parameters set forth therein. All parts are percentages by volume unless otherwise indicated.

EXAMPLES

Preparation of Coating Composition

A base coating was prepared as follows:

A fuser roll topcoat formulation was prepared from a solvent solution/dispersion containing 100 parts by weight of a hydrofluoroelastomer, DuPont Viton® GF, a polymer of 35 weight percent vinylidenefluoride, 34 weight percent hexafluoropropylene and 29 weight percent tetrafluoroethylene and 2 weight percent of a cure site monomer. The Viton® GF is mixed with 7 parts by weight of DuPont Viton® Curative 50, 2.4 parts by weight magnesium oxide (Maglite D available from C. P. Hall, Chicago, Ill.), 1.2 parts by weight calcium hydroxide, 1.2 parts by weight carbon black (N990 available from R. T. Vanderbilt Co.), 6.7 parts by weight Novec™ FC-430 (available from 3M) in a mixture of methylethylketone and methylisobutyl ketone, which was dispensed onto the fuser roll surface using the flow coat method to a nominal thickness of about 20 micrometers. The coating was cured by stepwise heating in air at 95° C. for 2 hours, 175° C. for 2 hours, 205° C. for 2 hours, and 230° C. for 16 hours.

Flow Coating is described as dripping material spirally over a horizontally rotating cylinder. Generally, in this flow coating method, the coating is applied to the substrate by rotating the substrate in a horizontal position about a longitudinal axis and applying the coating from an applicator to the substrate in a spiral pattern in a controlled amount so that substantially all the coating that exits the applicator adheres to the substrate. For specific details of an embodiment of the flow coating method, attention is directed to U.S. Pat. No. 5,945,223, entitled "Flow Coating Solution and Fuser Member Layers Prepared Therewith" and to U.S. Pat. No. 6,408, 753 and U.S. Pat. No. 6,521,330, entitled "Flow Coating Process for Manufacture of Polymeric Printer and Belt Components," and to U.S. Pat. No. 6,479,158, entitled "Fuser Member with an Amino Silane Adhesive Layer and Preparation Thereof," the disclosures of which is hereby incorporated by reference in its entirety. For specific details of an embodiment of fuser roll top coat compositions, attention is directed to U.S. Pat. No. 5,332,641, entitled "Fuser Member with an Amino Silane Adhesive Layer," the disclosures of which is hereby incorporated by reference in its entirety.

The control coating is described above. The trial material is described below. This yielded a final dried coating with the following approximate composition with respect to the total amount of Viton GF™ by weight: 3.3 parts per hundred (pph) BYK 167, 1.5 pph Magnesium 170 special, 0.75 pph Calcium Hydroxide, 0.75 pph Carbon Black N990 and 7 pph Viton Currative 50. The remainder of the coating is occupied by a solvent such as MEK or MibK or a mixture thereof. This solvent is volatile and not present in an appreciable amount in the final dried and cured coatings.

Fuser Rolls.

Four rolls were coated using the above described coating composition comprising a deflocculating agent. Additionally, eight control fuser rolls (C1-C8) were prepared with control coating compositions. The fuser rolls were prepared as follows. Roll substrates are turned from aluminum tubes to the correct geometry. Steel endcaps or "journals" are then inertia welded to each end of the roll. A primer is then applied to the aluminum substrate and allowed to dry. Next, a silicone layer is molded onto the core by liquid injection molding and allowed to cure. A lengthy post cure process then takes places to drive all residuals from the silicone layer. At this point, the silicone layer thickness is on the order of 10 mm. Next, the silicone is ground using an abrasive wheel. The silicone is now about 5 mm thick. The ground roll is sanded by a process known as superfinishing to achieve a proper surface finish. The roll is cleaned with a solvent, usually isopropyl alcohol or methanol. At this point, an adhesive can be applied to the silicone. This is done under normal conditions, but when using the deflocculating agent, it was found to not be entirely necessary. Several adhesives exist, including HV10, Z6040 and A4040 all made by Dow Corning, and Chemlok 5150 made by Lord Corporation. Finally, the coating solution is applied by the two-component flow coating method described above.

Adhesion testing was conducted on the fusers that employed the outer coating composition comprising the deflocculating agent. Adhesion was tested by 90 degree peel test using an Instron test in pull mode. A strip is adhered to the surface of the roll and pulled via Instron to determine the stress required to peel the Viton coating away from the silicone layer. The results of the testing are shown in Table A.

Adhesion Results (90 degree peel test). In further testing using higher levels of BYK 167, it was found the adhesion could be increased to 2.0-2.5 lbs/in. This is on the order of control formulations and is an acceptable level for roll performance.

TABLE A

| Deflocculated Roll | Trial | Ave. Load/width ibf/in |
|---|---|---|
| 1 | 1 | 1.32 |
| 1 | 2 | 1.33 |
| 2 | 1 | 1.16 |

TABLE A-continued

| Deflocculated Roll | Trial | Ave. Load/width ibf/in |
|---|---|---|
| 2 | 2 | 1.35 |
| 3 | 1 | 1.09 |
| 3 | 2 | 1.27 |
| 4 | 1 | 1.00 |
| 4 | 2 | 1.45 |
| Average | | 1.2463 |
| Standard Deviation | | 0.1501 |

Gloss and roughness of both the experimental and control fuser rolls were also evaluated. The results of these tests are shown in Tables B and C.

TABLE B

| Deflocculated Roll | Average Gloss GGU | RA um | Rmax um | Rz um | Wt um |
|---|---|---|---|---|---|
| 4 | 92.925 | 0.27 | 8.31 | 3.61 | 6.08 |
| 3 | 93.425 | 0.20 | 3.36 | 3.36 | 5.60 |
| 2 | 93.025 | 0.22 | 1.79 | 1.79 | 5.23 |
| 1 | 92.950 | 0.20 | 2.09 | 2.09 | 3.73 |
| Average | 93.081 | 0.223 | 3.888 | 2.713 | 5.160 |
| Standard Deviation | 0.233 | 0.033 | 3.026 | 0.906 | 1.015 |

TABLE C

| | Average Gloss GGU | Ra um | Rmax um | Rz um | Wt um |
|---|---|---|---|---|---|
| 1 | 86.450 | 0.22 | 7.91 | 6.31 | 5.36 |
| 2 | 86.325 | 0.22 | 8.29 | 4.47 | 4.11 |
| 3 | 85.850 | 0.24 | 8.29 | 5.89 | 3.46 |
| 4 | 86.100 | 0.29 | 11.52 | 8.65 | 4.22 |
| 5 | 83.800 | 0.29 | 13.06 | 9.33 | 5.48 |
| 6 | 85.900 | 0.28 | 11.14 | 9.04 | 4.12 |
| 7 | 86.200 | 0.26 | 8.18 | 6.47 | 4.89 |
| 8 | 85.650 | 0.26 | 8.44 | 6.58 | 5.11 |
| Average | 85.784 | 0.258 | 9.604 | 7.093 | 4.594 |
| Standard Deviation | 0.844 | 0.029 | 1.989 | 1.724 | 0.718 |

Tables 3 and 4 show that the fusers comprising a deflocculating agent in the outer layer composition exhibited a decrease in the roughness and improved gloss. In this particular experiment the average gloss of fusers comprising the deflocculating agent in the outer layer was about 8 gloss units higher than the average for the control fusers. As previously mentioned, a variation in as little as 2 gloss units is detectable to the human eye. Additionally, the fuser rolls comprising the deflocculating agent showed no signs of barium sulfate defect or other visual defects (such as fisheyes, mudcracking, solvent popping, etc.).

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A fuser member for fixing a developed image to a copy substrate comprising:

a substrate; and thereover an outer layer comprising a haloelastomer and a copolymer of polycaprolactone and aromatic polyisocyanurate based on tolyl diisocyanate, wherein the copolymer of polycaprolactone and aromatic polyisocyanurate based on tolyl diisocyanateis present in an amount of from about 1 to about 4 percent by weight of the haloelastomer.

2. The fuser member according to claim 1, wherein the haloelastomer comprises a fluoroelastomer selected from the group consisting of a) copolymers of vinylidenefluoride, hexafluoropropylene, and tetrafluoroethylene, b) terpolymers of vinylidenefluoride, hexafluoropropylene, and tetrafluoroethylene, c) tetrapolymers of vinylidenefluoride, hexafluoropropylene, and tetrafluoroethylene, and a cure sitemonomer, d) volume grafted fluoroelastomers, and combinations thereof.

3. The fuser member according to claim 1, wherein the haloelastomer comprises a Viton fluoroelastomer.

* * * * *